US005327745A

United States Patent [19]

Gilmour

[11] Patent Number: 5,327,745

[45] Date of Patent: Jul. 12, 1994

[54] MALONE-BRAYTON CYCLE ENGINE/HEAT PUMP

[75] Inventor: Thomas A. Gilmour, Crownsville, Md.

[73] Assignee: The United States of America as represented by the Secretary of the Navy, Washington, D.C.

[21] Appl. No.: 127,567

[22] Filed: Sep. 28, 1993

[51] Int. Cl.[5] ..... F25D 17/02

[52] U.S. Cl. ..... 62/467; 62/118; 417/406

[58] Field of Search ..... 62/114, 118, 467; 417/406

[56] References Cited

U.S. PATENT DOCUMENTS 3,079,764 3/1963 Westcott et al. ..... 62/467 X 4,353,218 10/1982 Wheatley et al. ..... 62/467 R

*Primary Examiner*—William E. Wayner

*Attorney, Agent, or Firm*—Charles D. Miller

[57] ABSTRACT

A machine, such as a heat pump, and having an all liquid heat exchange fluid, operates over a more nearly ideal thermodynamic cycle by adjustment of the proportionality of the volumetric capacities of a compressor and an expander to approximate the proportionality of the densities of the liquid heat exchange fluid at the chosen working pressures. Preferred forms of a unit including both the compressor and the expander on a common shaft employs difference in axial lengths of rotary pumps of the gear or vane type to achieve the adjustment of volumetric capacity. Adjustment of the heat pump system for differing heat sink conditions preferably employs variable compression ratio pumps.

14 Claims, 3 Drawing Sheets

PRESSURE (psia)
ENTHALPY (Btu/lbm)
MELTING LINE
T=0°F
T=80°
T=200°
T=240°
T=320°
T=400°
T=480°
T=560°
T=640°
T=720°
T=840°
D=70 lbm/ft3
S=0.72
D=65
S=0.76
D=60
S=0.80
D=55
D=50
D=40
S=.68
S=1.26
1.22
1.18
1.14
1.10
1.06
1.02
.98
.92
.86
.76
.7
.5
.3
x=.1
1.5
1.0
0.8
0.7
0.6
0.5
0.4 lbm/ft3

FIG. 4
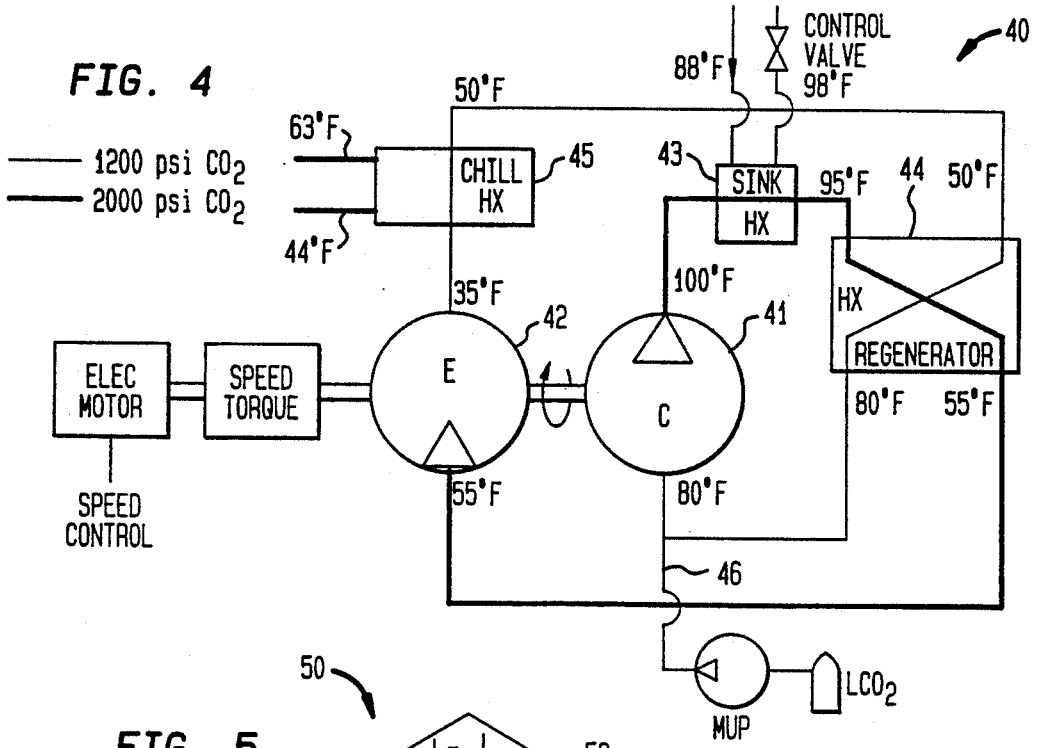
FIG. 5
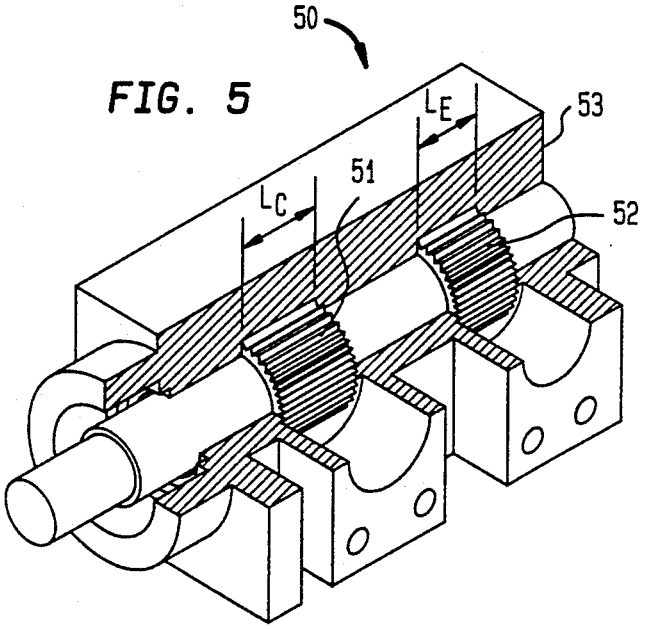
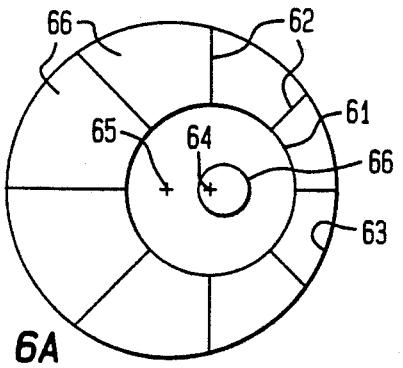
FIG. 6A
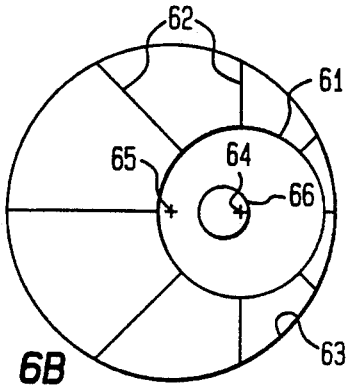
FIG. 6B

MALONE-BRAYTON CYCLE ENGINE/HEAT PUMP

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

1. Field of the Invention

The present invention generally relates to prime movers or heat pumps which operate over a closed thermodynamic cycle and, more particularly, to prime movers or heat pumps having a heat exchange fluid which is consistently in a liquid phase at all times during the thermodynamic cycle.

2. Description of the Prior Art

Many different machines which involve compression and expansion of a fluid (e.g. liquid or gas or a mixture of these phases) are known and used to change energy from one form to another to perform desired functions. Internal combustion engines and air-conditioning systems are particularly well-known and familiar examples of such machines. (As used hereinafter, the term "machine" will be used to refer generically to a device operating as either a heat pump or a prime mover. Theoretically, any thermodynamic system can potentially be operated as either a prime mover or a heat pump depending on whether heat is added to or rejected by the system.) Many of these types of devices, such as air conditioning systems, operate in a closed cycle in which the fluid is recirculated.

Many different thermodynamic mechanisms which can be employed in such machines are well-known and may be exploited with greater or lesser efficiency, depending on the design of the machine. Certain theoretical thermodynamic cycles having distinct properties are known by the names of their principal investigators such as the Stirling cycle which is characterized (for a heat pump) by constant volume heat rejection and constant temperature compression and expansion. As another example, the Brayton cycle (again for a heat pump) is characterized by constant pressure heat rejection and constant entropy expansion and compression. In both of these cycles and other known theoretical cycles, certain parameters are kept substantially constant during certain portions of the cycle and energy is often constrained to be ideally removed from or added to the system by variation of a single other parameter. Also, for a prime mover rather than a heat pump, in any theoretical ideal thermodynamic cycle, heat would be input rather than rejected.

Vapor compression machines operating in a closed cycle, such as most air-conditioners and refrigerators, operate by condensation and evaporation of a fluid since the change between phases is accompanied by a very large change of energy and volume of the material. The temperatures at which such condensation and evaporation can be carried out, however, is largely dependent on the properties of the fluid and the conditions under which it is contained. For this reason, so-called chlorofluorocarbons (CFCs) have become popular for use in air-conditioning and other heat pump applications (e.g. where mechanical energy is used to effect heat exchange) because of the temperatures at which heat exchange must take place. However, in recent years, extremely serious environmental damage has been attributed to release of chlorofluorocarbons into the atmosphere from such heat exchange systems (and other sources) and alternatives yielding similar efficiencies and convenience with environmentally neutral materials are being actively sought. Water remains one of the major materials of choice for prime movers (e.g. where energy is applied to the system as heat and removed as mechanical energy, as in a steam engine or turbine) but efficiency remains a serious concern for closed systems where the water must be condensed and recirculated.

While no viable alternatives have existed, it should be noted that the high compressibility of gaseous phase materials have required compressors and expanders of substantial volume in systems exploiting phase change of the heat exchange fluid. Therefore, in large-scale air-conditioning installations, for example, substantial space must be dedicated to the compressors. Heat exchangers also occupy substantial space because of the amount of heat which must be absorbed or rejected during evaporation and condensation. Since this space has an economic value, it must be considered as a cost of operating such systems. Reduction in the size of heat exchangers must often be accompanied by the capacity for increasing the differential of temperatures at which heat exchange takes place; increasing the capacity of compressors and the pressures at which they operate and thus the amount of energy input thereto with consequent decrease of system efficiency. This trade-off between energy input requirements and system size has made highly efficient heat pump installations very difficult and expensive when all economic costs are considered, especially for shipboard applications.

While ideal liquids have been traditionally regarded as incompressible and thermodynamically inert, about seventy years ago, it was noted by John Malone that some liquids may be compressed and expanded with substantial efficiency of conversion of heat to mechanical energy under conditions of temperature and pressure near the critical point of the liquid. For this reason, any ideal regenerative thermodynamic system employing all-liquid (e.g. consistently liquid during all portions of a thermodynamic cycle) heat exchange fluid is commonly referred to by the name "Malone" as a prefix to the name by which the ideal system is known. Several engines employing all liquid phase heat exchange fluid are reported to have been built by Malone and tested, following a Stirling cycle implemented with reciprocating pistons. While fairly high efficiencies relative to prime movers of that period were reported, the engine was not sufficiently advantageous to support commercialization at that time. Malone-type systems continue to be a subject of sporadic investigation but no way to exploit a Malone-type cycle with a sufficient degree of the efficiency theoretically available therefrom has heretofore been found to make a practical implementation of such a cycle in a machine competitive with other commercially available machines for performing desired functions. A summary of the state of the art in Malone-type cycles and an overview of the theoretical operation thereof for refrigeration is given in "Malone Refrigeration" by Greg W. Swift published in ASHRAE Journal, November, 1990, pp. 28–34. This article discusses a test heat pump constructed by the author and operating on a Stirling cycle using propylene but indicates that the design was principally concerned with versatility for quantitative characterizations of loss mechanisms and without concern for efficiency, size, cost or reliability. The article also suggests that pressurized carbon dioxide may be a suitable working fluid and that a Malone-Brayton cycle heat pump could be used for refrigeration.

The use of an expander mechanism is well-known in prime movers, such as jet engines, to provide an expander mechanism to extract mechanical power from the system, usually for driving the compressor and other ancillary equipment, such as generators. It is also known in some all gas phase Brayton cycle heat pump applications to provide an expander mechanism to extract mechanical power and reduce the amount of mechanical input power required. As with jet engines, it is common, for mechanical simplicity, to operate the expander and compressor on the same shaft. Since the functions of the expander and compressor are generally considered to be complementary functions and, as indicated above, liquids have classically been considered to be of substantially constant density for purposes of thermodynamic analysis (e.g. ideal liquids being regarded as incompressible), it has been the common practice to arrange for the fluid handling capacities (e.g. displacement, volume per revolution, etc.) of the expander and compressor to be the same, including previous demonstrations of Malone-type cycle machines.

SUMMARY OF THE INVENTION

It is therefore an object of the present invention to provide a high efficiency machine operating with all-liquid heat exchange fluid.

It is another object of the invention to provide a practical Malone-Brayton cycle heat pump.

It is a further object of the invention to provide a practical machine of high efficiency using an environmentally neutral heat exchange fluid in a closed system.

It is yet another object of the invention to provide a unitary compressor-expander for a machine operating in accordance with a thermodynamic cycle which is of relatively small size.

In order to accomplish these and other objects of the invention, a machine having a recirculated heat exchange fluid which is consistently in a liquid phase is provided, including a compressor having a first volumetric capacity for compressing the heat exchange fluid, a heat exchanger for receiving the heat exchange fluid from the compressor, an expander having a second volumetric capacity for maintaining pressure in the heat exchanger and for expanding the heat exchange fluid, wherein the second volumetric capacity of the expander is smaller than the first volumetric capacity of the compressor.

In a preferred form of the invention, the first and second volumetric capacities are made approximately proportional to the densities at the inlets of the expander and compressor, respectively.

BRIEF DESCRIPTION OF THE DRAWINGS

The foregoing and other objects, aspects and advantages will be better understood from the following detailed description of a preferred embodiment of the invention with reference to the drawings, in which:

FIG. 4 is a schematic diagram of a heat pump or prime mover utilizing a Malone-Brayton cycle in accordance with a preferred form of the present invention, FIG. 5 is a partially cut-away view of the unitary compressor/expander employing gear pumps in accordance with the invention, and FIGS. 6A and 6B are axial views of a vane-type pump suitable for implementing a perfecting feature of the invention.

DETAILED DESCRIPTION OF A PREFERRED EMBODIMENT OF THE INVENTION

Figure 1:
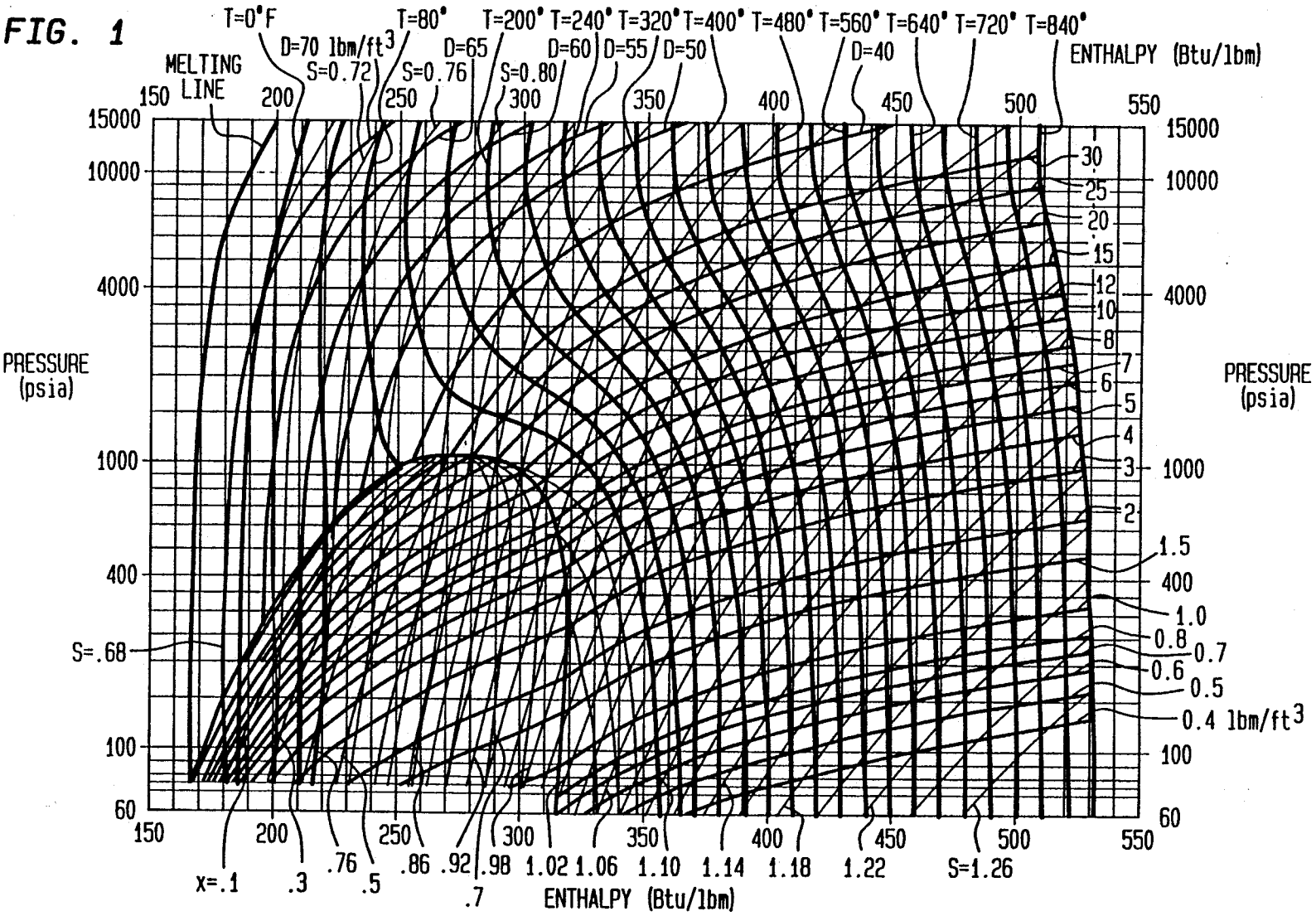
FIG. 1 is a Pressure-Enthalpy diagram for carbon dioxide.

Referring now to the drawings, and more particularly to FIG. 1, there is shown a Pressure-Enthalpy diagram for carbon dioxide as prepared by the Center for Applied Thermodynamic Studies, University of Idaho, Copyright 1985 by the American Society of Heating, Refrigerating and Air-Conditioning Engineers (ASHRAE). Similar diagrams for other materials are available in the literature. In FIG. 1, enthalpy (in units of BTU per pound mass) is plotted on a linear scale horizontally against pressure (in psia) on a logarithmic scale vertically. Curves extending generally diagonally from lower left to upper right of the diagram are equal density curves labelled with numbers in units of pounds mass per cubic foot. Other, more vertically oriented curves show points of equal entropy (S) in units of BTU/LBM-R. The remaining sigmoidally shaped curves extending generally vertically and in which the curvature becomes more pronounced from right to left are isothermal curves labelled in units of degrees Fahrenheit. A portion of one of these isothermal curves at the left of the diagram is the melting line and a saturation curve labelled "saturated liquid" at the left end (where it intersects the melting line) and "saturated vapor" at the other indicates points of phase change. The critical point is at the apex of this curve and forms the approximate upper enthalpy limit of the region of interest for operation of the invention.

Figure 2:
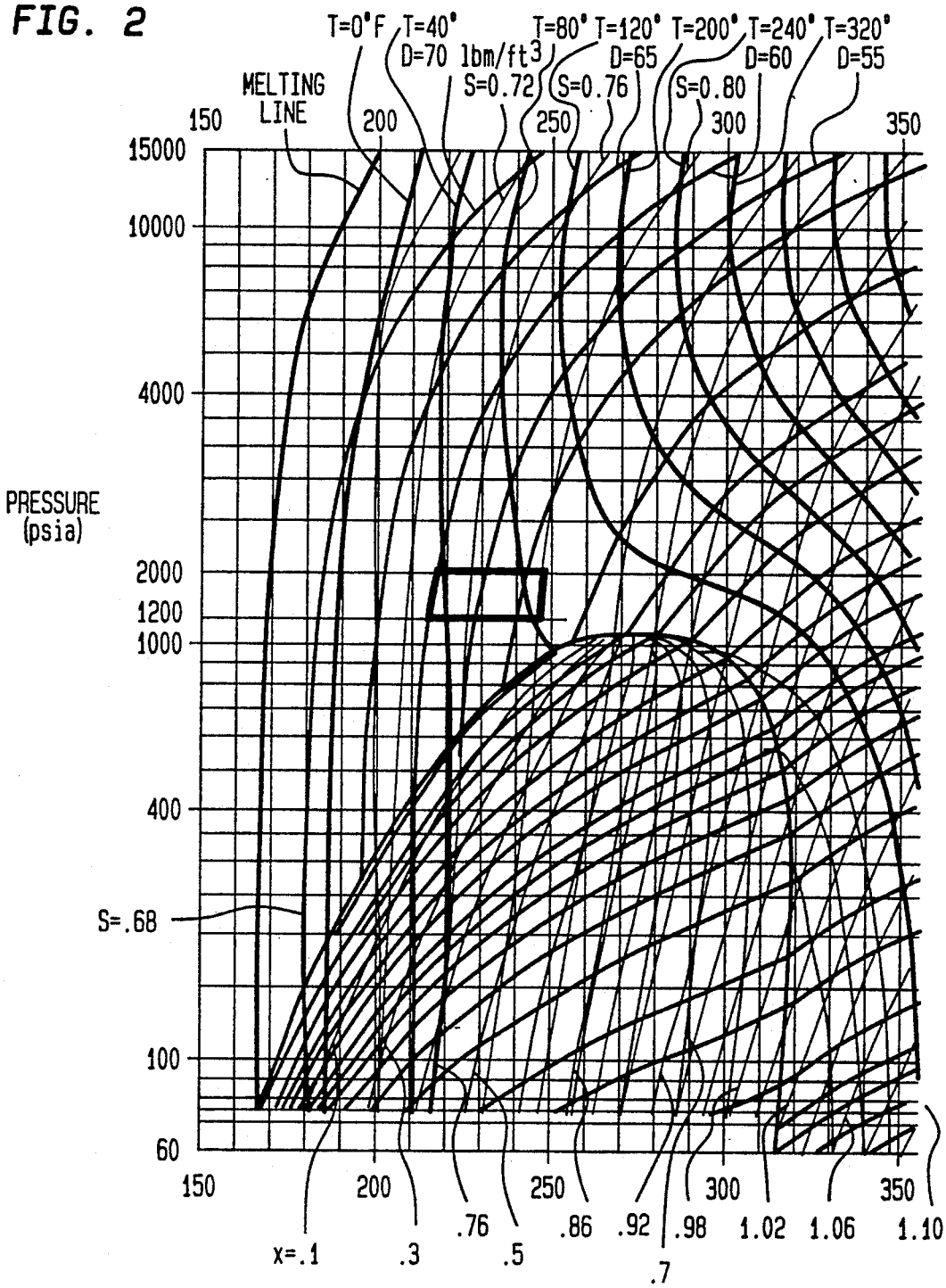
FIG. 2 is an enlarged portion of the Pressure-Enthalpy diagram of FIG. 1.

An enlarged region of FIG. 1 including the critical point is shown in FIG. 2 which is of particular interest in the practice of the preferred embodiment of the invention. As indicated above, a Brayton cycle is characterized by constant pressure heat rejection and constant entropy over the pressure and temperature changes during compression and expansion. It is also preferred in view of the intended shipboard 10 application of the heat pump in accordance with the invention, that heat rejection should take place at a maximum of 88° F. (a maximum temperature for seawater likely to be encountered) and heat exchange from the load (the environment from which heat is to be extracted) should take place at a minimum of 44° F. to provide a workable temperature differential above the freezing point of water to prevent icing of the heat exchanger. (These temperatures are specified by military design requirements and other temperatures could be used.) Therefore, the preferred, but not critical entropy limits of the Brayton cycle in accordance with the invention are chosen in accordance with these temperatures at the onset of expansion and compression, respectively, where isothermal lines corresponding to the working temperatures of FIG. 1 or 2 are widely separated, indicating a low degree of compressibility. The working region should also be chosen such that the change in density of the heat exchange fluid with changes in pressure is high.

Pressures are chosen to provide a differential of temperatures in order to drive heat exchange in heat exchangers designed to required sizes, fluid capacities and efficiencies. Again, for shipboard applications 100° F. is considered suitable for heat rejection to an 88° F. sink and 35° F. is considered suitable to cool a the load at 44° F. (These temperature margins are largely dictated by practical limits on size and efficiency of heat exchangers.) These temperatures correspond to temperature changes during compression and expansion and are preferably found by following equal entropy lines from a chosen point on an isothermal curve corresponding to the pressure chosen for compression to a pressure corresponding to the desired temperature differential above the corresponding isothermal curve to serve the heat load and for adequate efficiency of the heat exchanger extracting heat from that load. Therefore, the initial point A, shown in FIG. 3, of the compression cycle should be at a point of FIG. 1 or 2 where the angular divergence of the isothermal and equal entropy lines is relatively large. The size, weight and pressure capabilities of the compressor and expander designs may also be considered in the choice of working pressures. In the preferred embodiment of the invention, working pressures of 1200 and 2000 psia are presently considered suitable and exemplary choices for a heat pump using liquid carbon dioxide as a heat exchange fluid.

As shown in FIG. 4, the system 40 for a Malone-Brayton cycle heat pump (or prime mover) is similar in organization to that suggested in "Malone Refrigeration", incorporated by reference above. The system includes a compressor 41 and an expander 42. Preferably both the compressor and the expander are mounted on a common shaft which is driven from an electric motor. Thus, by virtue of the common shaft or other mechanical arrangement such as a belt or gear drive, energy extracted from the expanding fluid by the expander can be applied to the compressor to reduce the amount of energy supplied by the motor.

Heavy or darker lines in FIG. 4 indicate the higher pressure (e.g. 2000 psia) fluid passages while the light lines indicate lower pressure (e.g. 1200 psia) fluid passages. The low pressure line includes a chill heat exchanger 45 for removing heat from the heat load. The high pressure line includes a sink heat exchanger 43 for rejection of heat from the system. Both high and low pressure passages also direct heat exchange fluid through a regenerator heat exchanger 44 where heat is exchanged between the high and low pressure fluids. The specific designs of heat exchangers are not critical to the practice of the invention and appropriate designs will be evident to those skilled in the art in view of this description of the invention. An inlet 46 is also provided for charging the system with heat exchange fluid to about the lower working pressure (e.g. 1200 psia for carbon dioxide).

Figure 3:
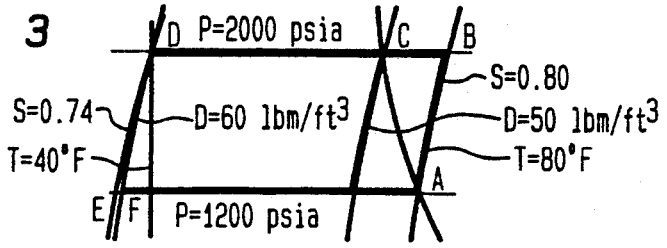
FIG. 3 is a diagram of the Malone-Brayton cycle in accordance with the preferred embodiment of the invention, extracted and enlarged from FIG. 2 for clarity.

Therefore, as shown in FIGS. 2 and 3 and indicated by temperatures and pressures in FIG. 4, the Malone-Brayton cycle in accordance with the preferred form of the invention ideally proceeds by compressing liquid carbon dioxide at a pressure of 1200 psia and a temperature of 80° F. to a pressure of 2000 psia (point A to point B of FIG. 3), causing a temperature rise of about 20° F. Then heat is rejected to a temperature of about 40° F., initially by heat exchange with sea water or other ambient fluid at 80° F. (point B to point C of FIG. 3) and then by further heat exchange with low temperature heat exchange fluid in a regenerator (point C to point D of FIG. 3) of any convenient design, such as a counterflow heat exchanger.

The heat exchange fluid, now at a low temperature but still at high pressure, is then expanded to a reduced pressure of 1200 psia (point D to point E of FIG. 3) while energy is extracted therefrom in an expander, causing further decrease in temperature to about 35° F. Then, heat is absorbed from the heat load in another heat exchanger to raise the temperature to 40° F. (point E to point F of FIG. 3) and further heated in the regenerator (point F to point A of FIG. 3) to 80° F., under which conditions, compression is again performed and the cycle repeated.

It has been discovered by the inventor that the Malone-Brayton cycle and other Malone-type cycles can be carried out in a most nearly ideal manner by considering the change in density of the heat exchange fluid at the temperatures and pressures at the onset of compression and expansion since, for suitable heat exchange fluids, the change of density will be high. In the example represented by the above-described preferred embodiment, the density of the working fluid changes from 60 $lbm/ft^3$ at the onset of expansion to about 47 $lbm/ft^3$ at the onset of compression. This corresponds to a change of about 22% in volume.

Since the expander must serve the dual function of maintaining the higher pressure during heat exchange with the heat sink and regenerator, and recovering work from the expanding fluid, the inventor has determined that the relative volumetric capacities (e.g. the displacement, if commonly or similarly driven) of the compressor and expander should be proportioned to the change in density of the heat exchange fluid during these portions of the cycle. While not wishing to be held to any particular theory of operation, it can be generally appreciated that the dual functions to be performed by the expander are closely interrelated. It is to be initially noted that in a closed system, the same mass of heat exchange fluid must, on average, be expanded and compressed during any given time interval. If the density of the liquid to be expanded is significantly greater than that of the liquid to be compressed, similar volumetric capacities of the compressor and expander will not permit the expander to maintain pressure during rejection of heat to a sink. At the same time, reduced pressure at the expander will allow less work to be extracted from the expanding fluid and impair expander efficiency as well as reducing the amount of rejected heat due to expansion during heat exchange when some expansion occurs due to loss of pressure in the heat exchanger and/or regenerator. This, in turn, adversely affects the performance of the regenerator which further reduces the efficiency of the heat pump by reducing the temperature differentials at the heat exchangers.

On the other hand, in accordance with the invention, if the expander is of smaller volumetric capacity in accordance with the density difference in comparison to the compressor, the expander can be optimized to pressures and flow regimes corresponding to pressures which can be maintained within close tolerances and maximum work can be extracted to minimize the required energy input for operation of the system. At the same time, the optimum performance of the heat exchangers and regenerator can be similarly maintained in accordance with their respective designs.

Thus, in summary, to implement a machine in accordance with the invention, the temperatures are chosen for the heat load and heat sink to be accommodated and temperature differentials corresponding to temperature changes in the compressor and expander is added in order to drive heat exchange at each of the heat exchangers 43 and 45. A heat exchange fluid is then selected which exhibits a high density change and low compressibility and which has a critical point near the upper working temperature limit and near the lower working limit of pressure to assure that the fluid remains in liquid phase. It should be noted that the critical point can be altered by adding other materials in solution in the working fluid, such as a few weight percent of methanol in liquid carbon dioxide. Other heat exchange fluids may also be used such as propylene and other materials noted in the above-incorporated article. Then the mass flow rate is computed based on heat exchanger efficiencies the working temperatures and the specific heat of the heat exchange fluid. Finally, from the mass flow rate and the densities of the heat exchange fluid at the working pressures, the volumetric flow rate can be calculated and suitable volumetric capacity hardware can be selected or fabricated. By following this methodology, a heat pump or prime mover can be designed in accordance with the invention for virtually any application.

A preferred structure 50 for the compressor and expander in a single assembly having a unitary casing 53 and on a common shaft is shown in partially cut-away form in FIG. 5. In this particular embodiment, gear pumps 51 and 52 are used for the compressor and expander, respectively. (A meshing gear in each gear pump is not shown.) If the diameters of the gear pumps and the design of the gear teeth is similar, the displacements will be proportional to the dimensions ($L_C$, $L_E$) of the gears in the axial direction. For this reason, gear pumps are an especially simple device with which to implement the invention since the proportionality of the axial extent of each of the gears need only be made approximately equal to the proportionality of the densities of the heat exchange fluid at the working temperatures and pressures. The proportionality need not be exact as can be appreciated by the fact that volume of the heat exchange fluid will change during compression and expansion. However, if the volumetric capacities of the expander and compressor are made proportional to the densities of heat exchange fluid at the inlets of the expander and compressor, respectively, the closest approach to an ideal thermodynamic cycle will be achieved.

The compressor-expander assembly is extremely compact for a given heat exchange capacity by virtue of the low compressibility of the heat exchange fluid, and liquid-to-liquid heat exchangers are more compact than heat exchangers in which a phase change occurs. This compactness of both the compressor-expander assembly and the heat exchangers is sufficient to compensate for the additional weight and volume of the regenerator, as compared to vapor compression systems. Thus, the invention presents no disadvantage in cost, size or weight in comparison with vapor compression type systems.

In view of the foregoing, it is seen that the invention provides a viable alternative to CFC-based heat pumps which is of potentially comparable efficiency, comparable size and uses an environmentally neutral or benign material as a heat exchange fluid. It should also be understood that the principles of the invention are applicable to prime movers as well as heat pumps and that the volumetric adjustment for density employed in this invention can be employed to improve the efficiency of any Malone-type system regardless of the ideal thermodynamic cycle exploited. For example, in a Stirling cycle machine using reciprocating pistons in cylinders, one piston and cylinder is always used for compression and another for expansion. Therefore, the efficiency can be increased and the rotational vibration induced in a common crankshaft used to reciprocate the pistons (as is suggested in the above-incorporated article) could be reduced.

For practical use of the invention, some variation in temperatures available at the sink heat exchanger must be anticipated which can be much larger than changes in the heat load. For example, in a shipboard installation, a heat pump is usually employed principally for the cooling of equipment such as electronics and data processing devices which presents a substantially constant heat load. The environmental heat contribution to the heat load is relatively small. However, the temperature of sea water used as a heat sink may vary from 30° F. to about 80° F. Such variation can be reflected in substantial changes of temperature at the sink heat exchanger which may exceed desired operating temperatures and cause malfunctioning of the system.

As a perfecting feature of the invention and to prevent lower than desired temperatures at the chiller heat exchanger and which may cause icing thereof, the efficiency of the system can be adjusted by altering the heat exchange rate in the regenerator, such as by constituting the regenerator with a plurality of heat exchanger sections, in parallel and valves for selectively controlling flow through different combinations of heat exchanger sections. However, it is considered preferable to change the compression ratio of the pump structures used as the compressor and expander since the system capacity can then be regulated by alteration of pressure excursion without significant loss of efficiency.

Several types of variable compression ratio pumps are commercially available. One type which preserves the simplicity of the embodiment of FIG. 5 is a so-called vane pump, shown in FIGS. 6A and 6B, commonly used in hydraulic systems such as automobile power steering arrangements. In this type of pump, a rotor 61 carries vanes 62 which are extended by springs (not shown) to the inner surface of a generally cylindrical cavity 63, dividing the volume of the cylindrical cavity into a plurality of chambers. The rotor 61 turns on an axis 64 which is spaced from but parallel to the axis 65 of the cavity. Thus, the volumes 66 of the chambers defined by the vanes are changed by rotation of the rotor. The degree of change of the volumes defined by the vanes can thus be altered by changing the spacing of the rotor shaft 64 from the cavity axis 65, as can be readily accomplished by an eccentric mechanism 66 for defining the position of rotor axis 64. This alteration of volumes and compression ratio of vane-type pumps is readily apparent from a comparison of FIGS. 6A and 6B in which the positions of eccentric 66 illustrate minimum and maximum compression ratio, respectively. Thus, the pressures and volumetric capacity can readily be changed while preserving the proportionality of compressor and expander capacity since, as with gear pumps, the proportionality of volumetric capacities of the compressor and expander can be established by axial length of the vanes which is invariant with compression ratio.

While the invention has been described in terms of a single preferred embodiment, those skilled in the art will recognize that the invention can be practiced with modification within the spirit and scope of the appended claims.

Having thus described my invention, what I claim as new and desire to secure by Letters Patent is as follows:

1. A machine having a recirculated heat exchange fluid which is consistently in a liquid phase, said machine including a compressor means having a first volumetric capacity for compressing said heat exchange fluid, a heat exchange means for receiving said heat exchange fluid from said compressor, an expander means having a second volumetric capacity for maintaining pressure in said heat exchange means and for expanding said heat exchange fluid, wherein said second volumetric capacity is smaller than said first volumetric capacity.

2. A machine as recited in claim 1, wherein said machine is a heat pump.

3. A machine as recited in claim 1, wherein a proportionality between said first volumetric capacity and said second volumetric capacity approximates a proportionality between a density of said heat exchange fluid at a pressure to which it is compressed by said compressor means and a density of said heat exchange fluid at a pressure to which it is expanded by said expander means.

4. A machine as recited in claim 1, wherein said heat exchange fluid principally comprises pressurized carbon dioxide.

5. A machine as recited in claim 1, wherein said heat exchange fluid includes an additive material for altering a critical point of said heat exchange fluid.

6. A machine as recited in claim 5, wherein said heat exchange fluid principally comprises pressurized carbon dioxide and said additive material is methanol.

7. A machine as recited in claim 1, wherein said compressor means and said expander means include gear pumps.

8. A machine as recited in claim 7, wherein said gear pumps of said compressor means and said expander means have different axial dimensions.

9. A machine as recited in claim 1, wherein said compressor means and said expander means include vane pumps.

10. A machine as recited in claim 9, wherein said vane pumps of said compressor means and said expander means have different axial dimensions.

11. A machine as recited in claim 9, wherein said vane pumps have a variable compression ratio.

12. A machine as recited in claim 2, wherein said heat exchange means includes a regenerator.

13. A machine as recited in claim 12, wherein said regenerator includes a plurality of heat exchanger sections and a plurality of valves for selectively controlling flow of said heat exchange fluid through ones of said plurality of heat exchanger sections.

14. A machine as recited in claim 1, wherein said compressor means and said expander means are pumps connected to a common shaft whereby work recovered by said expander means is applied to said compressor means.

* * * * *